US010775035B2

(12) United States Patent
Treible, Jr. et al.

(10) Patent No.: US 10,775,035 B2
(45) Date of Patent: Sep. 15, 2020

(54) EXPLOSION-PROOF ENCLOSURE WITH FLAME PATH MAINTENANCE AND PROTECTION MEANS

(71) Applicant: Cooper Technologies Company, Houston, TX (US)

(72) Inventors: Daniel Robert Treible, Jr., Clay, NY (US); Budd Shaw Honda, Baldwinsville, NY (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 131 days.

(21) Appl. No.: 15/454,493

(22) Filed: Mar. 9, 2017

(65) Prior Publication Data

US 2017/0261193 A1 Sep. 14, 2017

Related U.S. Application Data

(60) Provisional application No. 62/306,357, filed on Mar. 10, 2016.

(51) Int. Cl.

| | |
|---|---|
| ***F21V 25/12*** | (2006.01) |
| ***F21V 15/01*** | (2006.01) |
| ***F21V 29/83*** | (2015.01) |
| ***F21V 31/00*** | (2006.01) |
| ***F21V 31/03*** | (2006.01) |
| ***F21Y 103/10*** | (2016.01) |
| ***F21V 23/00*** | (2015.01) |
| ***F21Y 115/10*** | (2016.01) |

(52) U.S. Cl.

CPC ..... *F21V 25/12* (2013.01); *F21V 15/01* (2013.01); *F21V 29/83* (2015.01); *F21V 31/005* (2013.01); *F21V 31/03* (2013.01); *F21V 23/001* (2013.01); *F21Y 2103/10* (2016.08); *F21Y 2115/10* (2016.08)

(58) Field of Classification Search

CPC ..... F21V 25/12; F21V 15/01; F21V 29/83; F21V 31/03; F21V 31/005; F21V 23/001; F21Y 2115/10; F21Y 2103/10

See application file for complete search history.

(56) References Cited

U.S. PATENT DOCUMENTS

| | | | | |
|---|---|---|---|---|
| 4,260,863 A | | 4/1981 | Appleton | |
| 4,388,681 A | * | 6/1983 | Meyer | F21V 23/02 362/267 |
| 4,620,061 A | | 10/1986 | Appleton | |
| 4,796,159 A | | 1/1989 | Miksche | |

(Continued)

FOREIGN PATENT DOCUMENTS

| | | |
|---|---|---|
| WO | 98/05014 A1 | 2/1998 |
| WO | 2015/038806 A1 | 3/2015 |
| WO | 2016/196876 | 12/2016 |

OTHER PUBLICATIONS

International Search Report and Written Opinion for Application No. PCT/US2017/021517 dated May 26, 2017.

(Continued)

*Primary Examiner* — Tsion Tumebo

(74) *Attorney, Agent, or Firm* — Merchant & Gould P.C.

(57) ABSTRACT

Explosion-proof enclosures having one or more flame paths and one or more grooves for protecting the flame paths and/or assisting in accessing and measuring the flame paths, and methods for coating the explosion-proof enclosures.

21 Claims, 7 Drawing Sheets

(56) References Cited

U.S. PATENT DOCUMENTS

| | | | | |
|---|---|---|---|---|
| 5,012,395 | A * | 4/1991 | Wettengel | F21V 15/013 362/222 |
| 5,667,736 | A * | 9/1997 | Chien | F21S 8/035 264/1.37 |
| 6,109,979 | A * | 8/2000 | Garnett | H01R 13/527 439/573 |
| 8,170,390 | B2 | 5/2012 | Hand | |
| 8,562,722 | B2 | 10/2013 | Manahan et al. | |
| 8,692,139 | B2 | 4/2014 | Aldrich et al. | |
| 8,754,341 | B2 | 6/2014 | Manahan | |
| 8,764,243 | B2 | 7/2014 | Zimmer et al. | |
| 8,777,535 | B2 | 7/2014 | Manahan | |
| 8,821,622 | B2 | 9/2014 | Manahan et al. | |
| 8,844,749 | B2 | 9/2014 | Manahan et al. | |
| 8,908,357 | B2 | 12/2014 | Manahan | |
| 9,033,547 | B2 | 5/2015 | Manahan et al. | |
| 9,106,001 | B2 | 8/2015 | Hagerty et al. | |
| 9,145,912 | B2 | 9/2015 | Manahan | |
| 9,246,264 | B2 | 1/2016 | Daly et al. | |
| 9,272,821 | B2 | 3/2016 | Manahan et al. | |
| 9,351,129 | B2 | 5/2016 | Zukas et al. | |
| 9,355,800 | B2 | 5/2016 | Henderson | |
| 9,366,058 | B2 | 6/2016 | Zhao et al. | |
| 9,368,905 | B2 | 6/2016 | Ledgerwood et al. | |
| 9,428,312 | B2 | 8/2016 | Manahan | |
| 9,466,917 | B2 | 10/2016 | Ledgerwood et al. | |
| 9,509,146 | B2 | 11/2016 | Manahan | |
| 9,551,445 | B2 | 1/2017 | Morse et al. | |
| 9,553,435 | B2 | 1/2017 | Manahan et al. | |
| 2006/0225328 | A1 | 10/2006 | Hasan | |
| 2009/0084782 | A1 | 4/2009 | Helmer | |
| 2009/0135607 | A1 | 5/2009 | Holloway | |
| 2009/0161352 | A1* | 6/2009 | Mackin | F21V 19/04 362/217.02 |
| 2009/0288909 | A1 | 11/2009 | Slack | |
| 2010/0097235 | A1 | 4/2010 | Holloway | |
| 2010/0157596 | A1* | 6/2010 | Wen | F21V 31/005 362/235 |
| 2010/0284150 | A1 | 11/2010 | Manahan et al. | |
| 2013/0249375 | A1* | 9/2013 | Panagotacos | H05B 33/0803 313/13 |
| 2014/0118990 | A1* | 5/2014 | Ki | F21V 9/16 362/84 |
| 2014/0331533 | A1* | 11/2014 | Hasan | G09F 13/0413 40/570 |

OTHER PUBLICATIONS

Dialight brochure pages for SafeSite® LED Linear Fixture—UL 844 for Indoor and Outdoor Hazardous Applications http://www.unimar.com/wp-content/uploads/2017/01/SafeSiteLEDLinear_R.pdf.

Crouse-Hinds by Eaton product brochure pages for EJB Custom-Built Control Panels (2013), www.crouse-hinds.com.

Cooper Crouse-Hinds Pauluhn product brochure pages for XPFMax Commander/al, http://www.cooperindustries.com/content/dam/public/crousehinds/drilling-marine-products/catalog-pdfs/xpfmax-commander-al.pdf.

Nema7.com Adalet product brochure pages for Explosionproof Enclosures XCE Series & XJF, http://nema7.com/.

Crouse-Hinds by Eaton product brochure pages for ECP Series Explosionproof Enclosures for OEM Applications (2013), http://www.cooperindustries.com/content/dam/public/crousehinds/resources/pdfs/literature/ecp-enclosures-brochure.pdf.

Cooper Crouse-Hinds Pauluhn product brochure pages for XPFMax Commander/br, http://www.crouse-hindslatam.com/uploads/pdfs/products/families/8.Iluminacion%20Laton%20Areas%20Clas.pdf.

STAHL product brochure pages for LED Linear Luminaires EXLUX 6002/6402 (2016), http://r-stahl.com/.

Crouse-Hinds by Eaton product brochure pages for Hazard•Garde EVLL Series LED (2015), http://www.cooperindustries.com/content/dam/public/crousehinds/resources/pdfs/literature/hazardgard-evll-led-brochure.pdf.

Cooper Crouse-Hinds Pauluhn product brochure pages for XPFMax Performer/al, http://www.coopermiddleeast.com/content/dam/public/crousehinds/drilling-marine-products/catalog-pdfs/xpfmax-performer-al.pdf.

STAHL product brochure pages for lighting innovative solutions for global use (2014), www.stahl.de.

* cited by examiner

EXPLOSION-PROOF ENCLOSURE WITH FLAME PATH MAINTENANCE AND PROTECTION MEANS

CROSS REFERENCE TO RELATED APPLICATIONS

This application claims the benefit of U.S. Provisional Patent Application No. 62/306,357, filed Mar. 10, 2016, which application is hereby incorporated by reference in its entirety.

BACKGROUND

Explosion proof enclosures are commonly used in hazardous locations in order to contain explosions that may occur within the enclosure and prevent sparks occurring within the enclosure from igniting vapors, gases, or other materials in the area surrounding the enclosure. Hazardous locations may include, for example, aircraft hangars, gasoline stations, marine vessels, rigs, paint finishing locations, agricultural areas, etc.

The National Electric Code (NEC®) defines classes and divisions of hazardous locations, as well as requirements for explosion proof enclosures used in such locations. For example, a Class I hazardous location or area is one in which flammable gases or vapors are/could become present in concentrations sufficient to produce explosive and/or ignitable mixtures. Typical class I areas can include, for example, areas in marine vessels, on-shore and off-shore rigs, and petroleum processing facilities. Within Class I, a Division 1 area or location includes: one where the atmosphere of the area is expected to contain explosive mixtures of gases, vapors or liquids during normal working operations; one where ignitable concentrations frequently exist because of repair or maintenance operations; or one where there is release of ignitable concentrations of gases or vapors due to equipment breakdown, while at the same time causing electrical equipment failure. A Class I, Division 2 hazardous location includes: one where flammable liquids or gases are handled, but not expected to be in explosive concentrations, with the possibility of explosive concentrations resulting from an accidental rupture or other unexpected incident; one where ignitable gases or vapors are normally prevented from accumulating by positive mechanical ventilation, but could exist in ignitable quantities if there is a failure in the ventilation system; and areas adjacent to Class I, Division 1 locations where it is possible for ignitable concentrations of gas/vapors to enter the area due to lack of proper ventilation. Additional classes and divisions of hazardous locations are known in the art.

Explosion-proof enclosures rated for use in hazardous locations are typically equipped with one or more flame paths. Flame paths are designed for the passage and escape of burning gas resulting from an ignition that may take place within the enclosure itself (e.g., as a result of electrical arcing). As the burning gas passes through a flame path, the gas cools before being vented via the flame path into the atmosphere, thereby preventing the burning gas from igniting the volatile atmosphere in the hazardous location.

During the manufacturing and assembly of an explosion-proof enclosure, protecting the flame paths is critical to producing a safe product that conforms to regulations. A flame path located near an edge of a component of an enclosure is susceptible to being damaged when the component is handled (e.g., if the edge comes in contact with machinery or other objects) during the manufacture and assembly.

In addition, painting or otherwise coating exposed surfaces of enclosure components can lead to paint buildup at or near a flame path. Such paint accumulation can prevent access to the flame path (e.g., with a tool designed to measure the flame path to ensure it meets safe operating characteristics periodically during the lifetime of the enclosure). Furthermore, the maximum tolerance between adjacent components of explosion-proof enclosures is generally small. Paint/coating buildup on one component at or near a junction with another component can create unsafe gaps between components that exceed maximum tolerances.

There is a need for improved flame path protection and maintenance in explosion-proof enclosures.

SUMMARY

One aspect of the present disclosure relates to an explosion-proof enclosure comprising a first housing piece, a second housing piece coupled to the first housing piece, the first housing piece having a surface disposed at a flame path of the enclosure; and a groove disposed in the first housing piece, the groove surrounding the surface and following an outer perimeter of the second housing piece, the second housing piece at least partially covering the groove.

Another aspect of the present disclosure relates to an explosion-proof enclosure comprising a first housing piece, the first housing piece comprising an outer edge; a second housing piece; a flame path defined by a junction of the first housing piece and the second housing piece; and a groove, the groove being at least partially disposed at the outer edge of the first housing piece and abutting the flame path.

A further aspect of the present disclosure relates to an explosion-proof enclosure comprising a first housing piece having an outer edge, first and second areas, and a surface disposed at a first flame path of the enclosure; a second housing piece coupled to the first area of the first housing piece; a first groove disposed in the first housing piece, the first groove surrounding the surface and following an outer perimeter of the second housing piece, the second housing piece partially covering the first groove; a third housing piece coupled to the second area of the first housing piece; a second flame path defined by a junction of the first housing piece and the third housing piece; and a second groove, the second groove being at least partially disposed at the outer edge of the first housing piece and abutting the second flame path.

A further aspect of the present disclosure relates to a method for coating an explosion-proof enclosure, the enclosure comprising a cover and a base, the base comprising a surface configured to form a flame path between the base and the cover, the base further comprising a groove that surrounds the flame path, the groove following an outer perimeter of the cover, the method comprising the steps of: removably securing a coating mask on the base such that the coating mask covers the flame path and at least a portion of the groove; applying a coating material to the base to coat at least one exposed surface of the enclosure, such that coating material enters the groove; and removing the mask from the base.

Still a further aspect of the present disclosure relates to a method for coating an explosion-proof enclosure, the enclosure comprising a first housing piece and a second housing piece, the first housing piece comprising a surface configured to form a flame path between the first housing piece and the second housing piece, the first housing piece further comprising a groove that surrounds the flame path, the groove following an outer perimeter of the second housing piece, the method comprising the steps of: removably securing a coating mask on the first housing piece such that the coating mask covers the flame path and at least a portion of the groove; applying a coating material to the first housing piece to coat at least one exposed surface of the enclosure, such that coating material enters the groove; and removing the mask from the first housing piece.

DETAILED DESCRIPTION

Figure 1A:
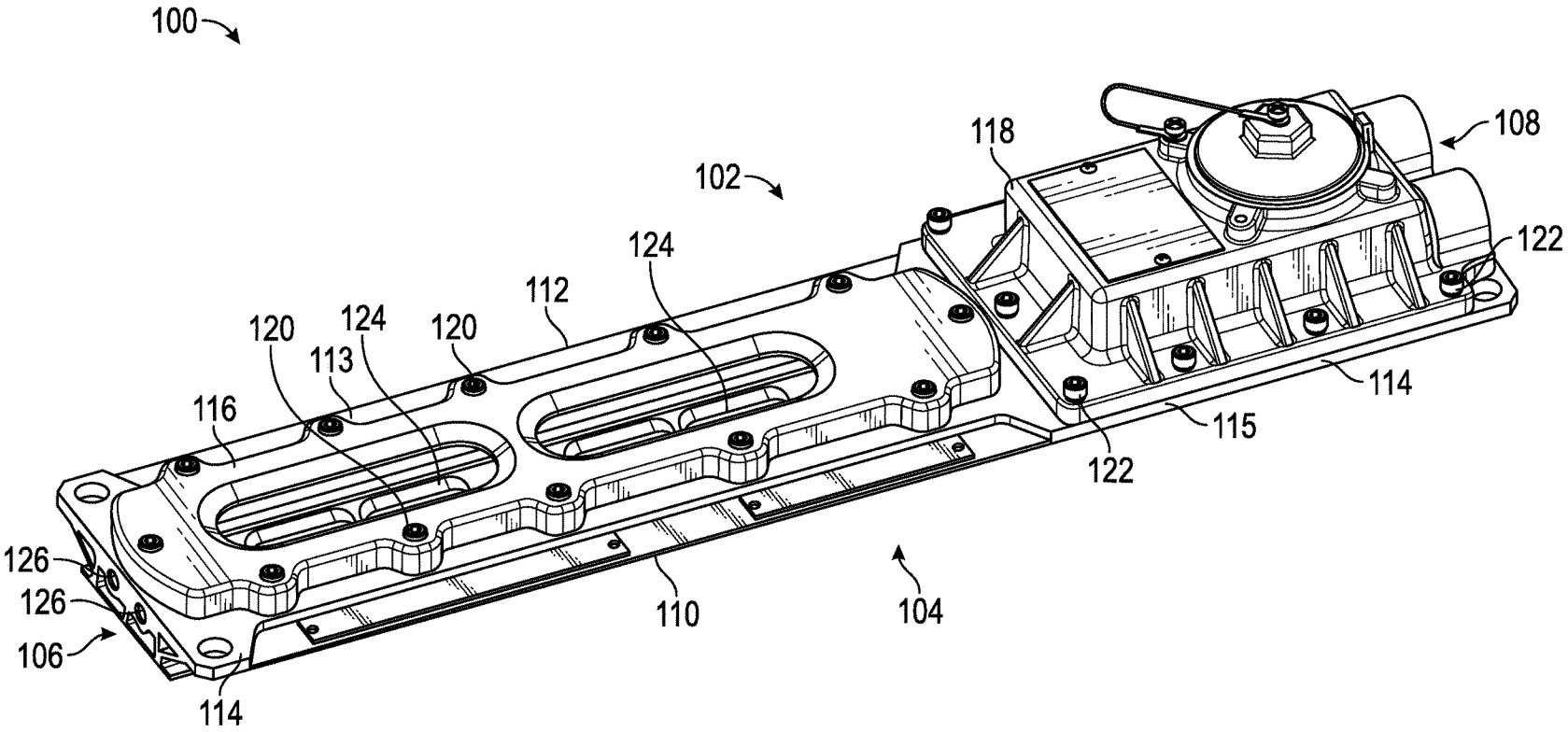
FIG. 1A is a bottom, front isometric view of an example explosion-proof enclosure in accordance with the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims. The figures are not necessarily drawn to scale.

Many hazardous areas require artificial lighting so that people working in the area have adequate visibility for their activities and environments. Lighting fixtures carry a risk of ignition, from arcing or other forms of sparking. Therefore, lighting fixtures for hazardous locations are specially configured to prevent burning gas from escaping the fixture and entering the volatile atmosphere of the hazardous area. Details of the present disclosure will now be discussed with reference to a particular embodiment of an explosion proof enclosure, namely, a light fixture. It should be appreciated, however, that the inventive principles of this disclosure are not limited to the described embodiment, and can be suitably applied to a variety of explosion-proof enclosures.

Figure 1B:
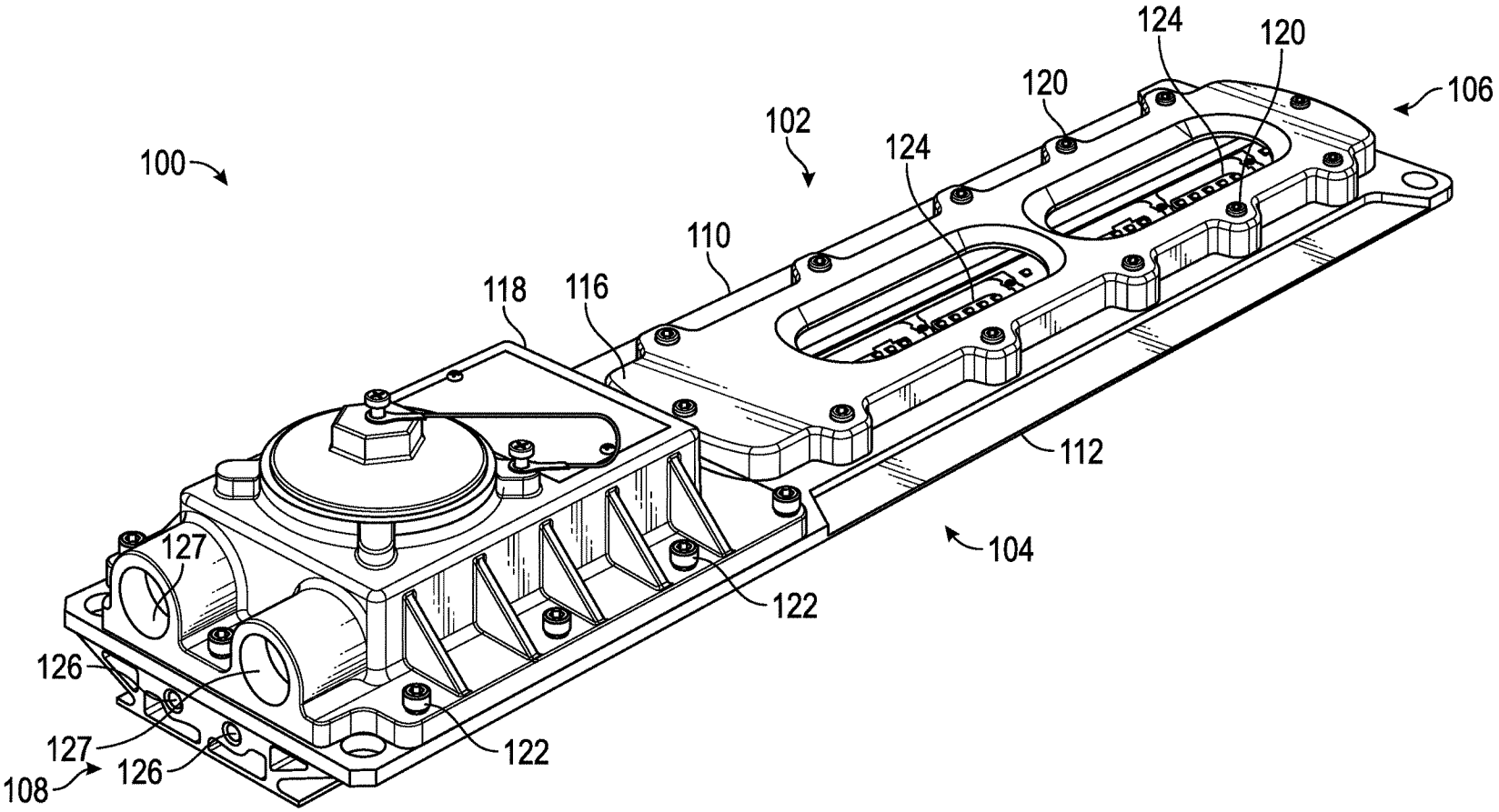
FIG. 1B is a bottom, rear isometric view of the explosion-proof enclosure of FIG. 1A.

FIG. 1A is a bottom, front isometric view of an example explosion-proof enclosure 100 in accordance with the present disclosure. FIG. 1B is a bottom, rear isometric view of the explosion-proof enclosure 100 of FIG. 1A. Throughout this disclosure, FIGS. 1A and 1B are referred to collectively as FIG. 1. With reference to FIG. 1, the explosion-proof enclosure 100 is generally defined by a bottom 102, a top 104, a front 106, a rear 108, a first side 110, and a second side 112. Typically, the top 104 will be mounted to a wall, ceiling or other structure in the hazardous environment, and light produced by the enclosure 100 passes through the bottom 102.

Throughout this disclosure, with respect to the enclosure 100, references to orientation (e.g., front(ward), rear(ward), in front, behind, above, below, high, low, back, top, bottom, under, underside, etc.) of structural components and positions shall be defined by the enclosure's bottom 102, top 104, front 106, and rear 108 as just defined with reference to FIG. 1, regardless of how the enclosure may be positioned in the field, during manufacturing or assembly, or otherwise. Words such as "interior" or "interiorly" are defined relative to the exterior of the enclosure 100, which is defined by its bottom 102, top 104, front 106, rear 108, first side 110 and second side 112.

With reference to FIG. 1, the example explosion-proof enclosure 100 includes a first housing piece (or base) 114, a second housing piece (or first cover) 116, and a third housing piece (or second cover) 118. The second housing piece 116 and the third housing piece 118 are configured to be mounted to the base 114 to cover portions of the base 114. The first housing piece 114 includes a first area 113 and a second area 115. The first area 113 of the first housing piece 114, and the second housing piece 116 are removably coupled together with coupling means (e.g., one or more screws, bolts, clips or other fasteners) 120. The third housing piece 118 and the second area 115 of the first housing piece 114 are removably coupled together with coupling means (e.g., one or more screws, bolts, clips or other fasteners) 122. In this example, an electrically powered lighting component 124 is disposed in the first housing piece 114. The second housing piece 116 secures the lighting component 124 in place in the first housing piece 114. In addition, in this example, a driver for powering and/or controlling the lighting component 124 is housed in a space between the first housing piece and the third housing piece. Passageways 126 enable electrical connectivity between the driver and the lighting component 124. During manufacture of the enclosure 100, electrical wiring can pass from the second area 115 via the port 147 into the passageways 126 (FIGS. 2, 3) of the first housing piece 114, connecting to the lighting component 124 via the port 145 (FIG. 3) in the first area 113. After wiring has been routed and completed through the enclosure 100, the ends of the passageways 126 can be plugged, e.g., with set screws. Connectivity to power and/or control sources external to the enclosure 100 can be routed to the driver through one or both of the sealable ports 127 (FIG. 1B).

Figure 2:
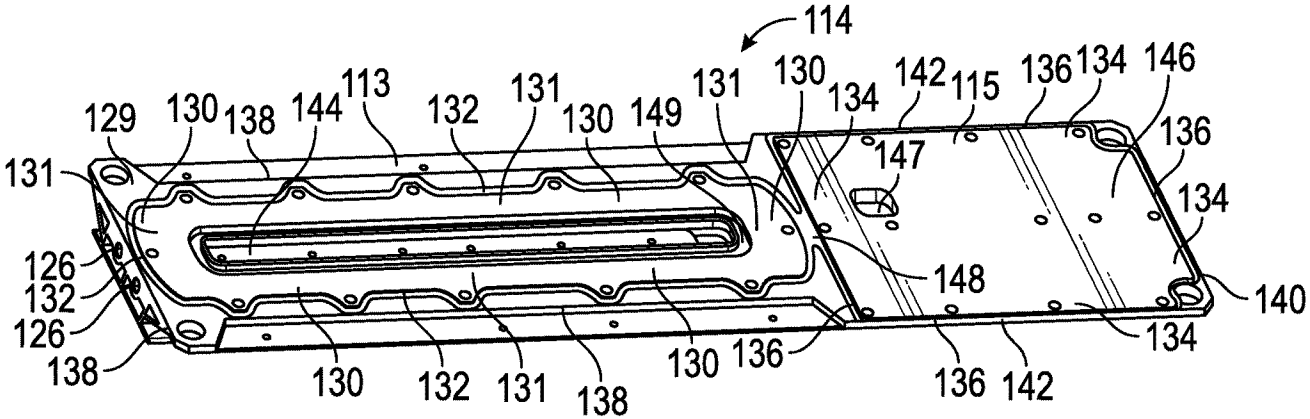
FIG. 2 is a bottom, front isometric view of a first housing piece of the explosion-proof enclosure of FIG. 1.
Figure 3:
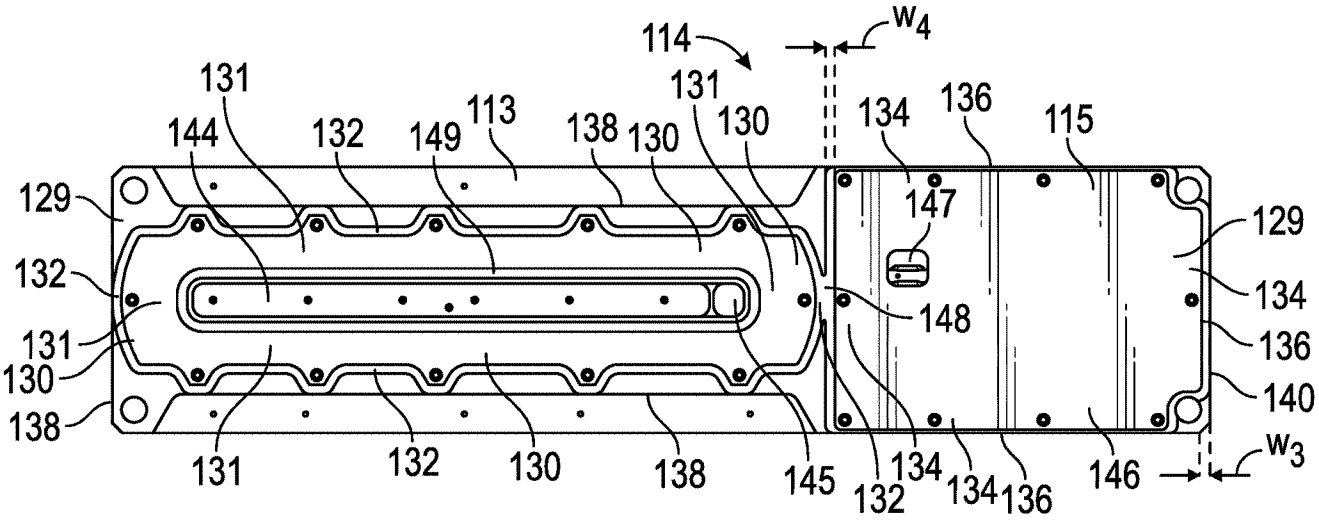
FIG. 3 is a bottom view of the first housing piece of FIG. 2.

FIG. 2 is a front, bottom isometric view of the first housing piece 114 of the explosion-proof enclosure 100 of FIG. 1. FIG. 3 is a bottom view of the first housing piece 114 of FIG. 2.

With reference to FIGS. 2-3, the first housing piece 114 includes the first area 113, the second area 115, and the passageways 126, as described above. In addition, in this example, the first area 113 includes a bottom 129, a bridging surface 130, a flame path surface 131, and a first groove 132, and the second area 115 includes a first contact surface 134 and a second groove 136. The first area 113 includes an edge 138 on three sides. The second area 115 includes a first edge component 140 on a first side, and a second edge component 142 on two sides. A recess 144 in the first area 113 is configured to support the lighting component 124 (FIG. 1). A surface 146 in the second area 115 is configured to support a driver for the lighting component 124 (FIG. 1). In addition, in this example, the first housing piece 114 includes a channel 149. The channel 149 surrounds the recess 144 and is configured to support a sealing component (e.g., a gasket) to seal off the lighting component.

The first groove 132 is disposed interiorly to the edge 138. The bridging surface 130 is disposed interiorly to the first groove 132 and spans a width from the first groove 132 to the flame path surface 131. The flame path surface 131 is interior to the bridging surface 130 and is disposed at the first flame path 206 (FIG. 9) when abutted against a surface of an adjacent component of the enclosure 100 (e.g., the glass pane 202 shown in FIG. 9). When the first housing piece 114 is coupled to the second housing piece 116 (FIG. 1), the second housing piece 116 covers (but, in some examples, does not contact) the bridging surface 130. In some examples, when the first housing piece 114 is coupled to the second housing piece 116, the second housing piece 116 covers at least part of the width of the first groove 132, e.g., a majority of a width of the first groove 132. In some examples, the shape of the space bounded by the first groove 132 is at least approximately defined by the outer perimeter 180 (FIG. 7) of the second housing piece 116.

The second groove 136 coincides with at least a portion each of the first edge component 140 and the second edge components 142 in the second area 115. That is, at least a portion of each of the first edge component 140 and the second edge component 142 is recessed relative to the level of the surface 146 corresponding to a depth of the second groove 136.

The first contact surface 134 is disposed interiorly to the second groove 136. When the first housing piece 114 is coupled to the third housing piece 118 (FIG. 1), the third housing piece 118 abuts and contacts the first contact surface 134. In some examples, when the first housing piece 114 is coupled to the third housing piece 118, the third housing piece 118 covers at least part of the width of the second groove 136, e.g., the entirety of the width of the second groove 136. In some examples, the shape of the space bounded by the second groove 136 is at least approximately defined by the outer perimeter 190 (FIG. 8) of the third housing piece 118.

As shown in FIGS. 2-3, in some examples, the first groove 132 and the second groove 136 can be optionally adjoined at a juncture 148 between the first area 113 and the second area 115. The juncture 148 provides groove continuity between the first area 113 and the second area 115. Typically, the grooves (132, 136) do not themselves require painting/coating. Thus, by providing groove continuity between the first area 113 and the second area 115, a single (rather than multiple) paint mask can be used on the bottom 129 of the first housing piece 114 when painting the exposed surfaces thereof.

As just described, to paint exposed surfaces of the first housing piece 114, one or more masks can be placed on the bottom 129 of the first housing piece 114, the mask having a shape corresponding to the outer perimeters (180, 190) of the second housing piece 116 (FIG. 7) and the third housing piece 118 (FIG. 8) (or, if using multiple masks, one mask can have a shape corresponding to the outer perimeter of the second housing piece 116 (FIG. 7) and another mask can have a shape corresponding to the outer perimeter of the third housing piece 118 (FIG. 8)). The advantages of the first groove 132 and the second groove 136 with respect to the paint/coating masking process will be described in greater detail below in connection with FIGS. 9-12.

Figure 4:
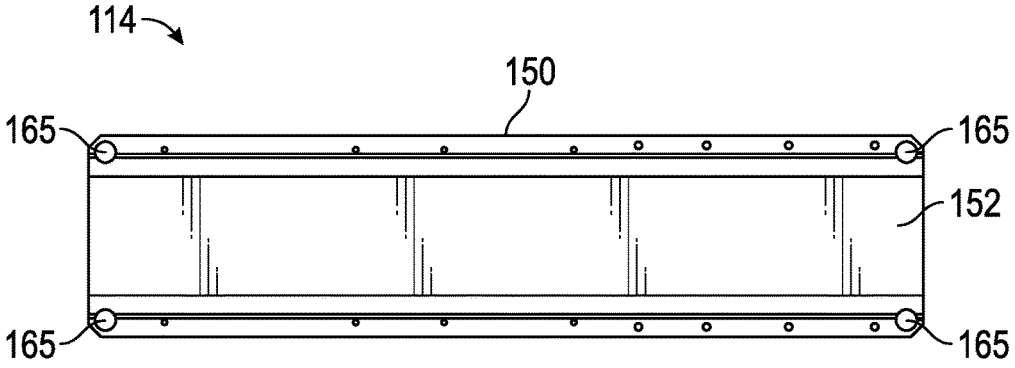
FIG. 4 is a top view of the first housing piece of FIG. 2.

FIG. 4 is a top view of the first housing piece 114 of FIG. 2. In this example, the first housing piece 114 includes an outer perimeter 150 and a mounting surface 152. A primary mounting system for the enclosure 100 includes the mounting surface 152, which can be secured directly to a surface in a hazardous location. Alternatively, one or more securing means, e.g., brackets that adjustably mount to the wings 163 of the mounting surface 152 and are bolted into a wall, ceiling or other fixture, can be coupled to the mounting surface 152 for securing the first housing piece 114 in a hazardous location. Holes 165 (FIG. 4) disposed at or near the corners of the first housing piece 114 can be provided to receive rope or other supporting material that can be tied to a fixture to provide secondary mounting support should the primary mounting support system fail.

Figure 5:
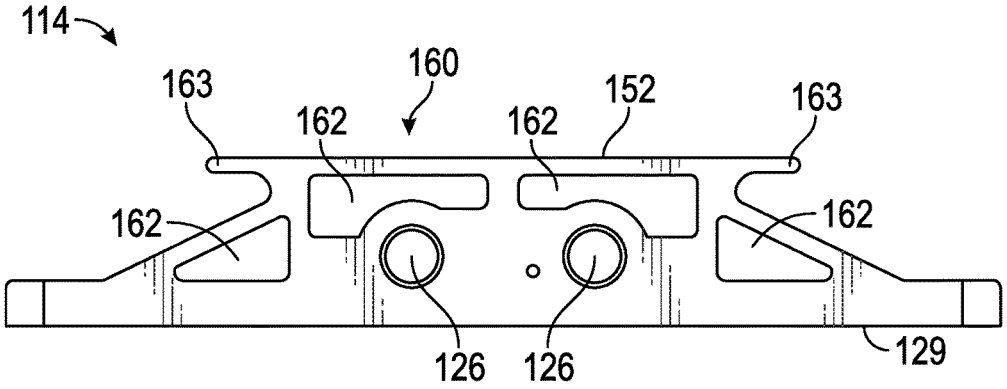
FIG. 5 is an end view of the first housing piece of FIG. 2.

FIG. 5 is an end view of the first housing piece 114 of FIG. 2. In this example, the first housing piece 114 includes the passageways 126, the bottom 129, and the mounting surface 152, as described above. In addition, in this example, the first housing piece 114 includes a top 160 (corresponding to the top 104 of the enclosure 100 in FIG. 1), and a plurality of cutouts 162. The cutouts 162 reduce the overall weight of the first housing piece 114, the shape and placement of the cutouts 162 being selected to minimize any loss of structural integrity to the enclosure 100.

Figure 6:
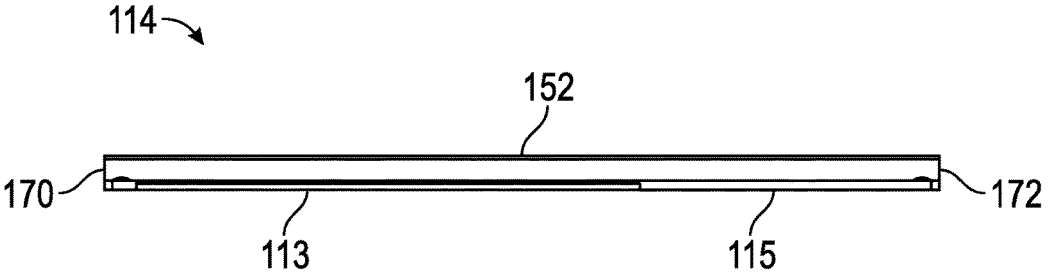
FIG. 6 is a side view of the first housing piece of FIG. 2.

FIG. 6 is a side view of the first housing piece 114 of FIG. 2, with the opposing side view being a mirror image thereof. In this example, the first housing piece 114 includes the first area 113, the second area 115, and the mounting surface 152, as described above. In addition, in this example, the first housing piece 114 includes a first end 170 adjacent the first area 113 (and corresponding to the first end 106 of the enclosure 100 of FIG. 1), and a second end 172 adjacent the second area 115 (and corresponding to the second end 108 of the enclosure 100 of FIG. 1).

Figure 7:
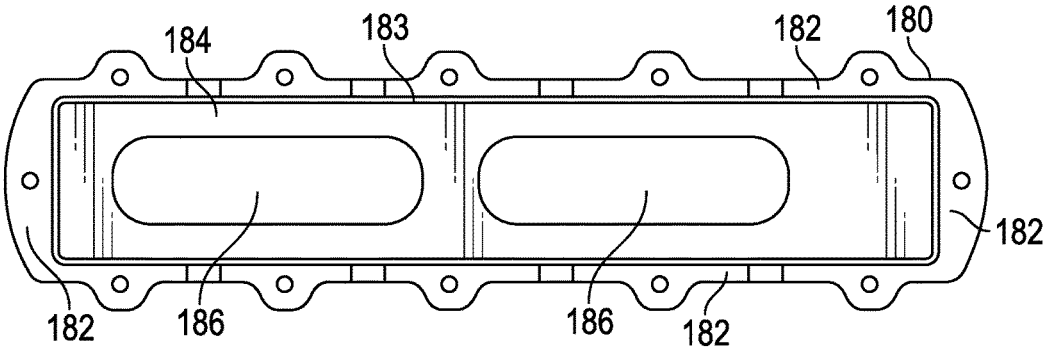
FIG. 7 is a top view of a second housing piece of the explosion-proof enclosure of FIG. 1.

FIG. 7 is a top view of the second housing piece 116 of the explosion-proof enclosure 100 of FIG. 1. The second housing piece 116 includes an outer perimeter 180, a bridge covering surface 182, a recess 183, a recessed surface 184, and openings 186.

In some examples, and as discussed above, the outer perimeter 180 can define or partially define the shape of a paint mask used to paint the bottom 129 of the first housing piece 114 (FIG. 2). The bridge covering surface 182 covers, but does not contact, the bridging surface 130 of the first housing piece 114 (FIG. 2) when the first housing piece 114 and the second housing piece 116 are coupled together via the coupling means 120. The recess 183 receives a transparent panel (e.g., a glass pane—see FIG. 9) that abuts the recessed surface 184 and covers the lighting component 124 (FIG. 1) to protect the lighting component 124 and to improve light dispersion. The openings 186 allow light to pass through the second housing piece 116 from the lighting component 124 (FIG. 1).

Figure 8:
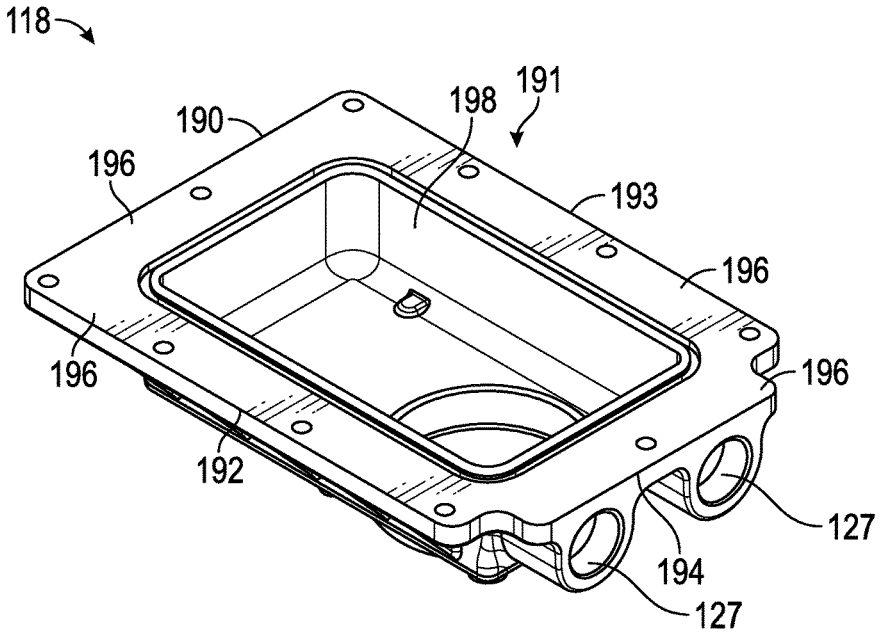
FIG. 8 is an isometric view of a third housing piece of the explosion-proof enclosure of FIG. 1.

FIG. 8 is an isometric view of the third housing piece 118 of the explosion-proof enclosure 100 of FIG. 1. In this example, the third housing piece has a top 191 and is defined by an outer perimeter 190, sides 192 and 193, and an end 194. The outer perimeter 190 defines a second contact surface 196. The third housing piece 118 also includes a cavity 198.

In some examples, and as discussed above, the outer perimeter 190 can define or partially define the shape of a paint mask used during a painting process of the bottom 129 of the first housing piece 114 (FIG. 2). In this example, the side 192 corresponds to the second side 112 of the enclosure 100 of FIG. 1, the side 193 corresponds to the first side 110 of the enclosure 100 of FIG. 1, and the end 194 corresponds to the second end 108 of the enclosure 100 of FIG. 1. The second contact surface 196 covers and contacts the first contact surface 134 of the first housing piece 114 (FIG. 2) when the first housing piece 114 and the third housing piece 118 are coupled together. The cavity 198 is configured to hold a driver to power and/or control the lighting component 124 (FIG. 1).

Figure 9:
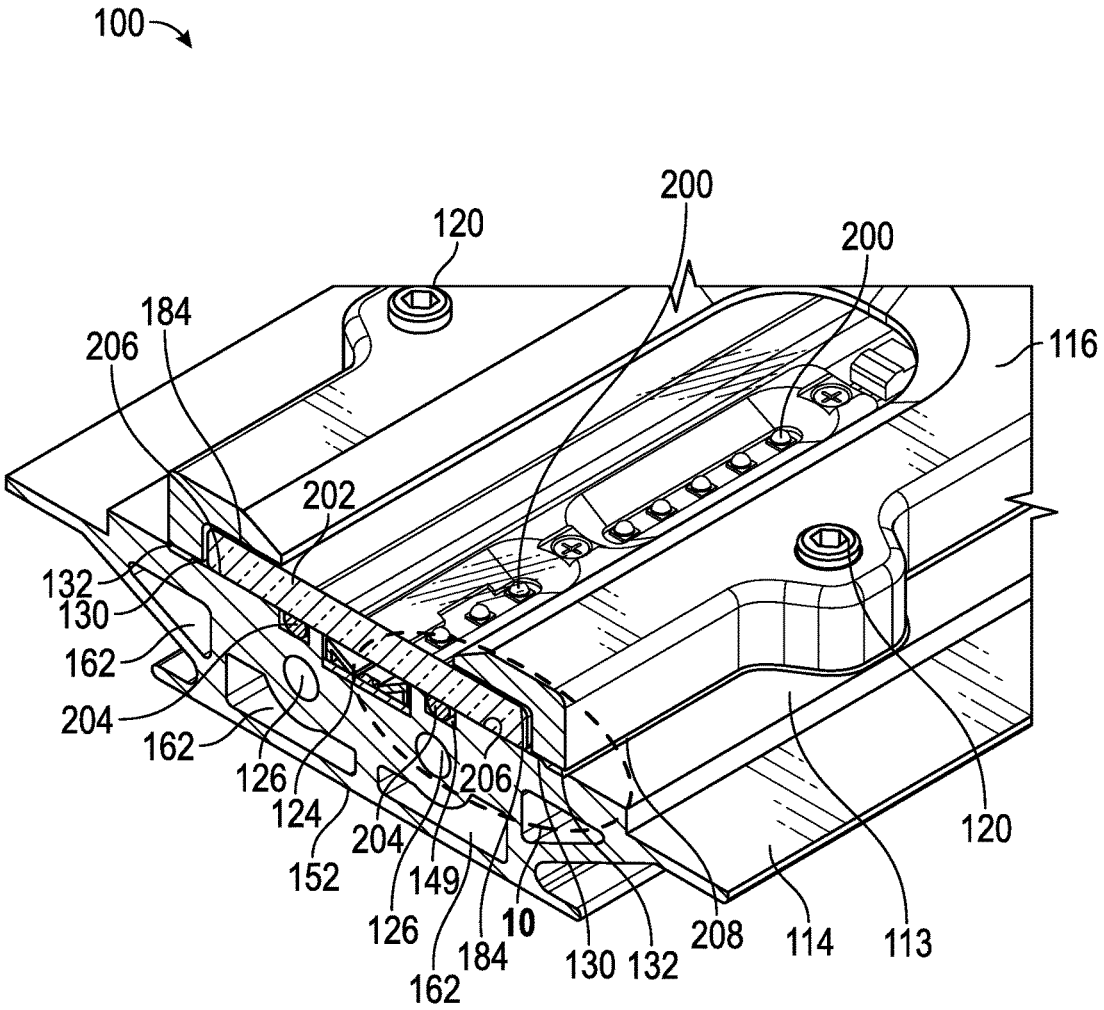
FIG. 9 is an expanded isometric cross-sectional view of a portion of the explosion-proof enclosure of FIG. 1.

FIG. 9 is an expanded isometric cross-sectional view of a portion of the explosion-proof enclosure 100 of FIG. 1. The enclosure 100 includes the first housing piece 114, the first area 113, the second housing piece 116, the coupling means 120, the lighting component 124, the passageways 126, the bridging surface 130, the first groove 132, the channel 149, the mounting surface 152, the cutouts 162, and the recessed surface 184, as discussed above. In addition, in this example, the lighting component 124 includes lighting elements 200, and the enclosure 100 includes a glass pane 202, a first gasket 204, and a first flame path 206.

The lighting elements 200 (e.g., light emitting diodes) are selected in type, power, number and configuration to emit light commensurate with the lighting needs of the hazardous location and any applicable hazardous location regulations.

The glass pane 202 covers the lighting component 124, and is disposed between the first housing piece 114 and the second housing piece 116, nesting in the recess 183 (FIG. 7) defined by the recessed surface 184. Thus, the second housing piece 116 acts as a bezel for the glass pane 202. In some examples, a spacer element 203 (e.g., a pad) (FIG. 10) is placed between the glass pane 202 and the second housing piece 116, to ensure an adequate gap between the bridging surface 130 and the bridge covering surface 182, to enable a measuring tool (e.g., a feeler gauge) to access the first flame path 206.

The first gasket 204 is disposed in the channel 149 that surrounds the lighting component 124. Contact between the first gasket 204 and the glass pane 202 forms a seal around the lighting component 124.

The first flame path 206 is a gas pathway formed at a junction where the glass pane 202 and the flame path surface 131 (FIG. 10) of the first housing piece 114 contact each other, and interior to the bridging surface 130. Burning gas resulting from the lighting component 124, or the wiring associated therewith, cools as it passes through the first flame path 206 towards the exterior of the enclosure 100.

With reference to FIG. 9, a majority of the width of the first groove 132 is covered by the second housing piece 116. However, in this example an access gap 208 between the edge of the second housing piece 116 and an outer edge of the first groove 132 is not covered, enabling a flame path measuring tool (e.g., a feeler gauge) to more easily enter the first groove 132 and thereby access the first flame path 206 via the gap between the bridging surface 130 and the bridge covering surface 182.

Figure 10:
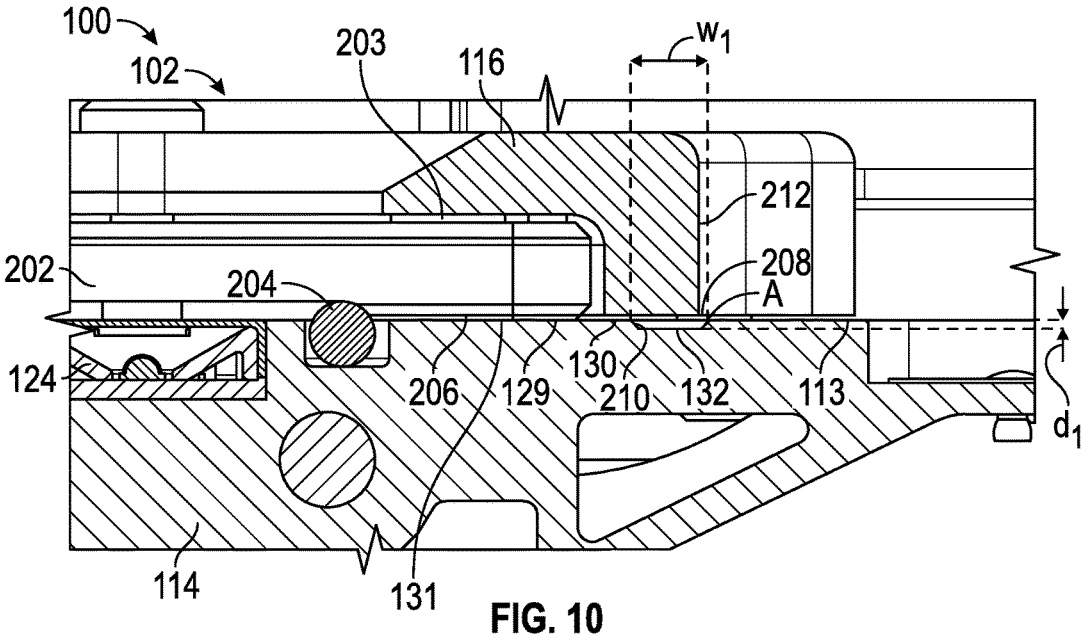
FIG. 10 is an end view of the call-out portion 10 of FIG. 9.

FIG. 10 is an end view of the call-out portion 10 of FIG. 9. FIG. 10 shows the enclosure 100 with top 102, the first housing piece 114, the first area 113, the second housing piece 116, the lighting component 124, the bottom 129, the bridging surface 130, the flame path surface 131, the first groove 132, the glass pane 202, the spacer element 203, the first gasket 204, the first flame path 206, and the access gap 208, as discussed above. In addition, in this example, the first groove 132 includes a beveled side 210, and the first groove 132 has a width $w_1$ and a depth $d_1$.

The beveled side 210 can facilitate access of a flame path measuring tool (e.g., a feeler gauge) to the first flame path 206, by providing a sloped (relative to the top 102) surface rather than a perpendicular surface, for the flame path measuring tool to slide along the beveled side 210 and into the gap between the bridging surface 130 and the bridge covering surface 182. In some examples, the side opposing the beveled side 210 can also be beveled, as shown in FIG. 10. This can help, for example, in extracting of a flame path measuring tool from the enclosure 100 following measurement of the first flame path 206.

Still with reference to FIG. 10, while painting exposed surfaces of the first housing piece 114, a mask can be placed on the first area 113 on the bottom 129 of the first housing piece 114, the mask extending to where the edge 212 (i.e., the outer perimeter 180) of the second housing piece 116 will be disposed when the enclosure 100 is fully constructed. The painting process can include the application of electrostatically charged coating powder to the exposed surfaces of the first housing piece 114, which is later melted into an epoxy.

The properties of the powder (e.g., its electrostatically charged nature) can cause the powder to accumulate at edges and corners, e.g., at the edge of the paint mask covering portions of the bottom 129 of the first housing piece 114. An area of such paint accumulation could therefore form in a strip along the bottom 129 of the first area 113 of the first housing piece 114 in a shape that corresponds to the shape or portion of the shape of the outer perimeter 180 (FIG. 7) of the second housing piece 116 (i.e., the shape of the mask). The approximate location of a hypothetical accumulation strip is identified as A in FIG. 10.

A strip of coating/paint accumulation as just described can inhibit or prevent necessary access to the first flame path 206 for measuring or monitoring the first flame path 206. Moreover, such a coating/paint accumulation can cause dangerous spacing between components of the enclosure 100, such as between the first housing piece 114 and the second housing piece 116, rendering the enclosure 100 unsuitable in a hazardous location due to the tight tolerances required to make an enclosure explosion-proof.

The first groove 132 can reduce or prevent undesirable coating/paint accumulation at the mask edge (while still enabling all exposed surfaces to be painted/coated) since the mask edge is disposed over a portion of the the first groove 132, the first groove 132 acting as a gap between the first housing piece 114 and the edge of the mask that the coating/paint does not bridge. In some examples, the first groove 132 captures excess paint/coating. In addition, beveling the sides of the first groove 132 can reduce sharp (e.g., right angled) edges, thereby further reducing the possibility of paint/coating accumulation.

In some examples, the width $w_1$ is in a range from about 0.15 inches to about 0.35 inches. In some examples, the width $w_1$ is about 0.25 inches. In some examples the depth $d_1$ is in a range from about 0.015 inches to about 0.035 inches. In some examples, the depth $d_1$ is about 0.025 inches. Widths and depths outside of these ranges may also be suitable. In some examples, both sides of the first groove 132 are beveled, and an arc formed by rays extending along the beveled sides has an angle of between about 60° and about 120°. In a particular example, this angle is approximately 90°. Angles outside of this range may also be suitable.

Figure 11:
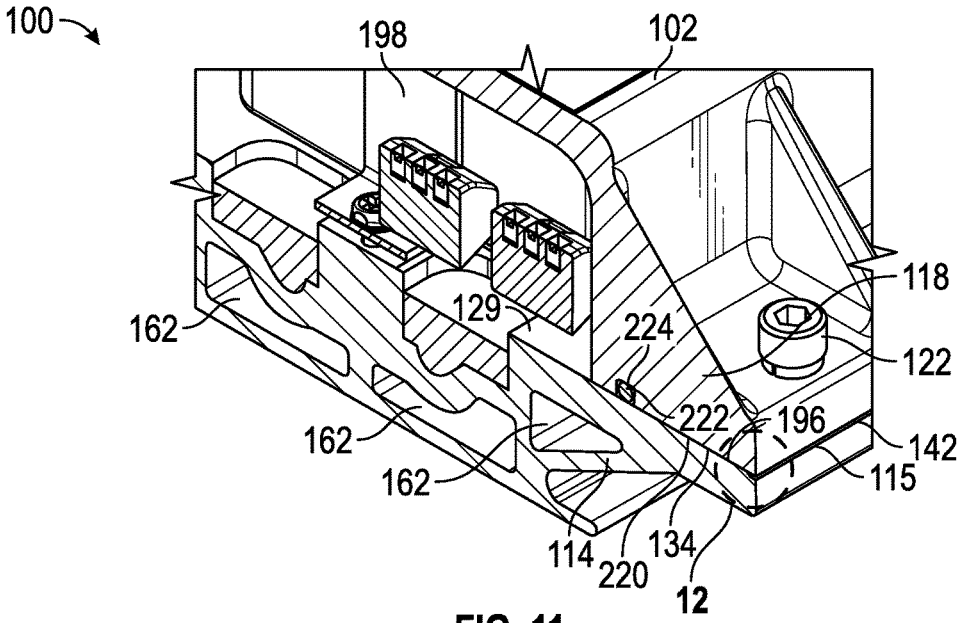
FIG. 11 is an expanded isometric cross-sectional view of a further portion of the explosion-proof enclosure of FIG. 1.
Figure 12:
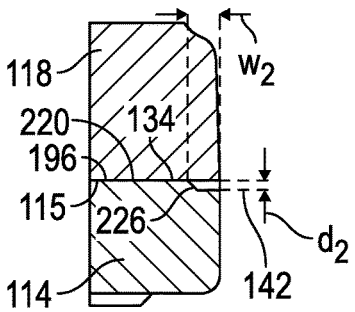
FIG. 12 is an end view of the call-out portion 12 of FIG. 11.

FIG. 11 is an expanded isometric cross-sectional view of a further portion of the explosion-proof enclosure 100 of FIG. 1. FIG. 12 is an end view of the call-out portion 12 of FIG. 11.

With reference to FIGS. 11-12, the enclosure 100 having a top 102 includes the first housing piece 114, the second area 115, the third housing piece 118, the coupling means 122, the bottom 129, the first contact surface 134, the second groove 136, the second edge component 142, the cutouts 162, the second contact surface 196 and the cavity 198, as discussed above. In addition, in this example, the enclosure 100 includes a second flame path 220, a second gasket 222, and a channel 224, and the second groove 136 includes a beveled side 226.

The second gasket 222 is disposed in the channel 224 and surrounds the cavity 198 to seal off the contents (e.g., an electrical driver) of the cavity 198. As shown, the second groove 136 is covered by the third housing piece 118 and coincides with the second edge component 142, and the first contact surface 134 is interior to the second groove 136.

The second flame path 220 is a gas pathway between the first contact surface 134 and the second contact surface 196, disposed interiorly to the second groove 136. In this example, the second flame path 220 is disposed between the second groove 136 and the second gasket 222. Burning gas resulting from the driver, or the wiring associated therewith, cools as it passes through the second flame path 220 towards the exterior of the enclosure 100.

The second groove 136 can reduce (e.g., by capturing excess coating/paint in the second groove 136) dangerous coating/paint accumulation at the second edge component 142 (and similarly at the first edge component 140 (FIG. 2)) that may otherwise occur during masking of the bottom 129 of the second area 115 of the first housing piece 114 when coating/painting the first housing piece 114. Such undesirable coating/paint accumulation could inhibit access to the second flame path 220 for measurement and/or maintenance, and could also space the third housing piece 118 from the first housing piece 114 beyond acceptable tolerances.

In addition, the second groove 136 can help protect the second edge component 142 (and similarly the first edge component 140 (FIG. 2)) from mechanical damage that could occur during handling of the first housing piece 114 and/or during assembly of the enclosure 100, thereby protecting the second flame path 220 from such mechanical damage.

A flame path measuring tool (e.g., a feeler gauge) can be introduced to the second flame path 220 via the second groove 136 at the second edge component 142. The beveled side 226 can facilitate access of a flame path measuring tool to the second flame path 220, by providing a sloped surface rather than a perpendicular surface, for the flame path measuring tool to slide along the beveled side 226 and into the second flame path 220. In addition, beveling the side of the second groove 136 can reduce sharp (e.g., right) angled edges, thereby further reducing the possibility of paint/coating accumulation.

In some examples, the width $w_2$ is in a range from about 0.05 inches to about 0.15 inches. In some examples, the width $w_2$ is about 0.087 inches. In some examples, the depth $d_2$ is in a range from about 0.015 inches to about 0.035 inches. In some examples, the depth $d_2$ is about 0.025 inches. With reference to FIG. 3, the second groove 136 at the first edge component 140 has a width $w_3$ in a range from about 0.15 inches to about 0.30 inches. In some examples, the width $w_3$ is about 0.22 inches. The second groove 136 at the first edge component 140 has a depth in a range from about 0.015 inches to about 0.035 inches. In some examples, the depth is about 0.025 inches. Widths and depths outside of these ranges may also be suitable. In some examples, the second groove 136 at the opposing side of the second area 115 from the first edge component 140 has a width $w_4$ (FIG. 3) and a depth, corresponding to the width $w_3$ and the depth, respectively, of the second groove 136 at the first edge component 140.

In an example method in accordance with the present disclosure, a base 114 of an explosion-proof enclosure 100 is provided, the enclosure having a cover (116, 118), the base having a surface configured to form a flame path (206, 220) between the base and the cover, the base further comprising a groove (132, 136) that surrounds the flame path (206, 220), the groove (132, 136) following an outer perimeter of the cover (116, 118), the method including: removably securing a coating mask on the base (114), the coating mask covering the flame path (206, 220) and at least a portion of the groove (132, 136); applying a coating material to the base 114 to coat at least one exposed surface of the enclosure (100), such that coating material enters the groove; and removing the mask from the base.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims

What is claimed is:

1. An explosion-proof enclosure comprising:
a first housing piece,
a second housing piece coupled to the first housing piece, the first housing piece having a surface disposed at a flame path of the enclosure; and
a groove disposed in the first housing piece, the groove surrounding the surface and following an outer perimeter of the second housing piece such that an outer edge of the second housing piece is positioned outside the groove and either adjacent the groove or adjacent an outer edge of the groove.

2. The explosion-proof enclosure of claim 1, wherein the groove is partially uncovered by the second housing piece.

3. The explosion-proof enclosure of claim 1, wherein the flame path is formed at a juncture between the first housing piece and a glass pane, the glass pane being disposed between the first housing piece and the second housing piece.

4. The explosion-proof enclosure of claim 1, wherein the groove comprises a beveled side; and wherein an access gap is disposed between the outer edge of the second housing piece and the outer edge of the groove, the access gap being configured to receive a flame path measuring tool.

5. The explosion-proof enclosure of claim 4, wherein the beveled side abuts the flame path.

6. The explosion-proof enclosure of claim 1, wherein the groove comprises two beveled sides.

7. The explosion-proof enclosure of claim 1, wherein the first housing piece comprises a lighting component and a gasket surrounding the lighting component, and wherein the flame path is disposed between the groove and the gasket.

8. An explosion-proof enclosure comprising:
a first housing piece, the first housing piece comprising an outer edge;
a second housing piece;
a flame path defined by a junction of the first housing piece and the second housing piece; and
a groove disposed in the first housing piece, the groove being at least partially disposed at the outer edge of the first housing piece and abutting the flame path, an outer edge of the second housing piece being positioned outside the groove and either adjacent the groove or adjacent an outer edge of the groove.

9. The explosion-proof enclosure of claim 8, wherein the groove comprises a beveled side.

10. The explosion-proof enclosure of claim 9, wherein the beveled side abuts the flame path.

11. The explosion-proof enclosure of claim 8, wherein the groove is configured to receive a flame path measuring tool.

12. The explosion-proof enclosure of claim 8, wherein the second housing piece completely covers the groove.

13. The explosion-proof enclosure of claim 8, wherein the second housing piece comprises a cavity, a driver disposed in the cavity and a gasket surrounding the cavity, and wherein the flame path is disposed between the groove and the gasket.

14. The explosion-proof enclosure of claim 8, wherein the groove at least approximately follows an outer perimeter of the second housing piece.

15. The explosion-proof enclosure of claim 8, wherein the groove is disposed in the first housing piece, the groove having an inner edge that terminates at an outer edge of a surface of the first housing piece along the entire length of the groove, the groove being recessed relative to the surface.

16. An explosion-proof enclosure comprising:

a first housing piece having an outer edge, first and second areas, and a surface disposed at a first flame path of the enclosure;

a second housing piece coupled to the first area of the first housing piece;

a first groove disposed in the first housing piece, the first groove surrounding the surface and following an outer perimeter of the second housing piece such that an outer edge of the second housing piece is positioned outside the groove and either adjacent the groove or adjacent an outer edge of the groove;

a third housing piece coupled to the second area of the first housing piece;

a second flame path defined by a junction of the first housing piece and the third housing piece; and a second groove, the second groove being at least partially disposed in the first housing piece at the outer edge of the first housing piece and abutting the second flame path.

17. The explosion-proof enclosure of claim 16, wherein the first flame path is formed at a juncture between the first housing piece and a glass pane, the glass pane being disposed between the first housing piece and the second housing piece.

18. The explosion-proof enclosure of claim 16, wherein each of the first groove and the second groove comprises a beveled side.

19. The explosion-proof enclosure of claim 16, wherein the first groove and the second groove are adjoining.

20. A method for coating an explosion-proof enclosure, the enclosure comprising a first housing piece and a second housing piece, the first housing piece comprising a surface configured to form a flame path between the first housing piece and the second housing piece, the first housing piece further comprising a groove that surrounds the flame path, the groove positioned to follow an outer perimeter of the second housing piece such that an outer edge of the second housing piece is positioned outside the groove and either adjacent the groove or adjacent an outer edge of the groove when the first and second housing pieces are coupled together, the method comprising the steps of:

removably securing a coating mask on the first housing piece such that the coating mask covers the flame path and at least a portion of the groove;

applying a coating material to the first housing piece to coat at least one exposed surface of the enclosure, such that coating material enters the groove; and removing the mask from the first housing piece.

21. An explosion-proof enclosure, comprising:

a first housing piece, including:

a surface disposed at a flame path of the enclosure; and a groove, the groove being recessed from the surface and surrounding the surface, the groove having an inner edge that terminates at an outer edge of the surface along the entire length of the groove; and a second housing piece coupled to the first housing piece, wherein the groove follows an outer perimeter of the second housing piece such that an outer edge of the second housing piece is positioned outside the groove and either abutting the groove or abutting an outer edge of the groove.

* * * * *